US005499616A

United States Patent [19]

Enright

[11] Patent Number: 5,499,616

[45] Date of Patent: Mar. 19, 1996

[54] CRANKCASE PRESSURE REGULATION SYSTEM FOR AN INTERNAL COMBUSTION ENGINE

[75] Inventor: Bernard F. Enright, Wauwatosa, Wis.

[73] Assignee: Dresser Industries, Inc., Dallas, Tex.

[21] Appl. No.: 447,199

[22] Filed: May 22, 1995

[51] Int. Cl.[6] ..... F01M 13/04

[52] U.S. Cl. ..... 123/572

[58] Field of Search ..... 123/572, 573, 123/574

[56] References Cited

U.S. PATENT DOCUMENTS

| | | | |
|---|---|---|---|
| 2,359,485 | 10/1944 | Lowther | 123/574 |
| 3,620,197 | 11/1971 | Albright | 123/574 |
| 3,754,538 | 8/1973 | Ephraim, Jr. et al. | 123/41.86 |
| 4,171,733 | 10/1979 | Voges | 123/119 |
| 4,172,437 | 10/1979 | Lindberg | 123/119 |
| 4,217,870 | 8/1980 | Schleiermacher | 123/572 |
| 4,373,499 | 2/1983 | Bendig | 123/574 |
| 4,557,226 | 12/1985 | Mayer et al. | 123/41.86 |
| 4,760,833 | 8/1988 | Tatyrek | 123/572 |
| 4,962,745 | 10/1990 | Ohno et al. | 123/573 |
| 5,069,192 | 12/1991 | Matsumoto et al. | 123/572 |
| 5,080,082 | 1/1992 | Mueller et al. | 123/574 |
| 5,335,641 | 8/1994 | Schnabel | 123/574 |
| 5,347,973 | 9/1994 | Walker | 123/574 |
| 5,429,101 | 7/1995 | Uebelhoer et al. | 123/572 |

*Primary Examiner*—Marguerite Macy
*Attorney, Agent, or Firm*—Andrus, Sceales, Starke & Sawall

[57] ABSTRACT

An improved crankcase pressure regulation system for an internal combustion engine has a floating-disk type vacuum pressure regulator operatively connected to a breather tube for blowby gases upstream of a flow restriction such as an oil separator. The breather tube has an inlet that receives crankcase blowby gases from a breather port in the crankcase and an outlet that feeds blowby gases into an air intake housing where the blowby gases are mixed with filtered engine intake air. The blowby gases are recirculated into the engine for combustion. The floating-disk type vacuum regulator has an air filter to filter ambient air that is added to the blowby gases and later recirculated into the engine air intake for combustion.

16 Claims, 4 Drawing Sheets

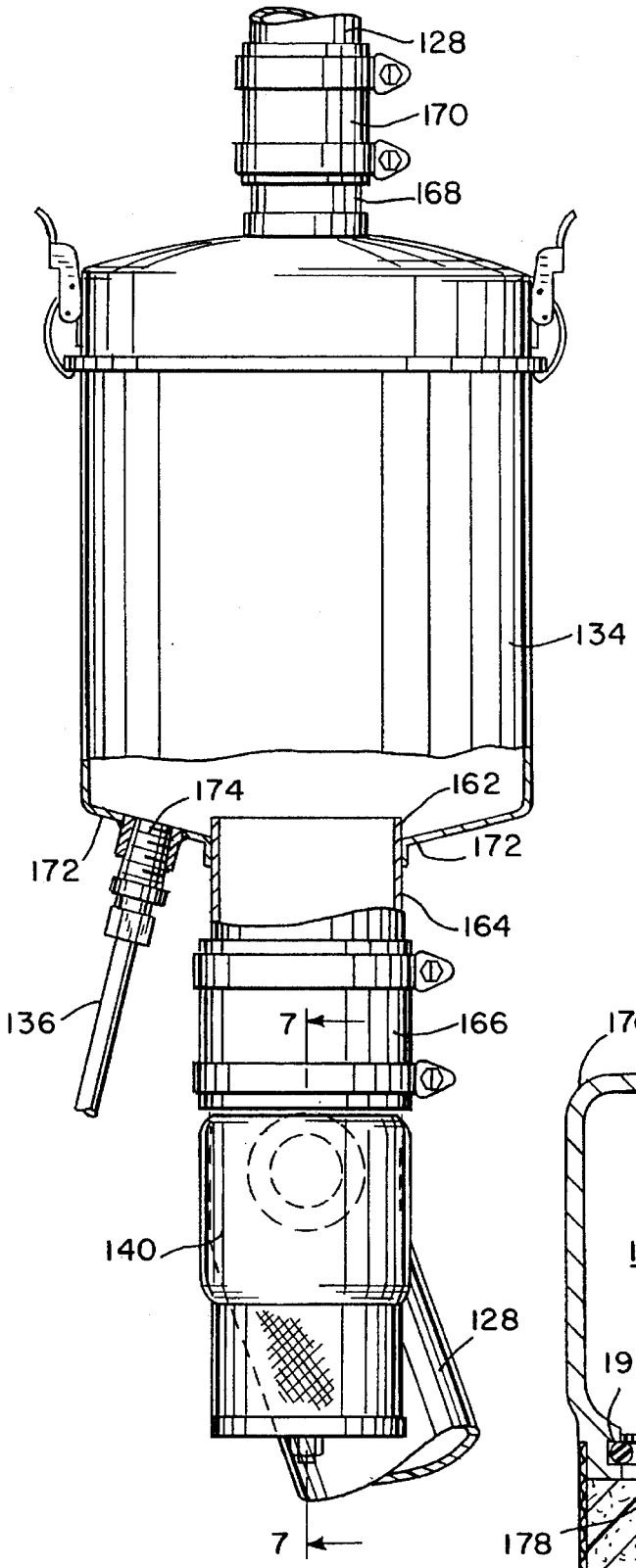
FIG.6
FIG.7
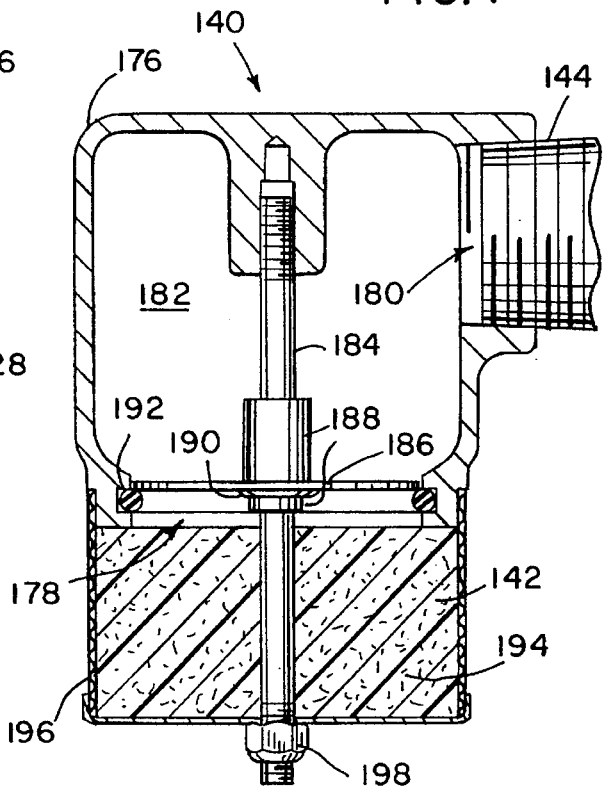

CRANKCASE PRESSURE REGULATION SYSTEM FOR AN INTERNAL COMBUSTION ENGINE

FIELD OF THE INVENTION

The invention relates to internal combustion engines and, in particular, to the regulation of crankcase pressures in an internal combustion engine.

BACKGROUND AND SUMMARY OF THE INVENTION

In most internal combustion engines, it is desirable to maintain pressure within the engine crankcase below atmospheric pressure thereby reducing leaks through gaskets and seals from the crankcase to the atmosphere. This is normally done by evacuating crankcase blowby gases through a breather system driven by a vacuum source.

In most cases, it is not desirable for the crankcase vacuum (i.e. negative crankcase pressure) to become excessive. If the crankcase vacuum is excessive, or if crankcase seals deteriorate, the vacuum can pull in outside air and dirt across the seals. For internal combustion engines, it is therefore preferred to maintain a slight crankcase vacuum. The magnitude of the vacuum should not vary excessively with such factors as engine speed or load, engine wear, or other factors which may affect the operation of the crankcase breather system.

The invention provides a crankcase pressure regulation system that can maintain negative crankcase pressure within narrow tolerances. The invention does this by adjusting the volumetric flow rate through the breather system.

The invention involves creating a negative pressure in the crankcase by drawing blowby gas from the crankcase and regulating the negative crankcase pressure by adding a regulated amount of air to the flow of the blowby gas drawn from the crankcase and thereafter restricting the combined flow. Since pressure losses across flow restrictions increase at a rate proportional to the square of volumetric flow through the restriction, the vacuum or pressure gradient drawing a flow of blowby gas from the crankcase can be precisely controlled by adding a relatively small amount of ambient air to the flow of blowby gas.

It is preferred that the regulated vacuum or pressure gradient drawing the flow of blowby gas from the crankcase be driven by a pressure drop across an engine air filter that is created by filtering engine intake air through the air filter. Such a system is advantageous because in such a system crankcase blowby gases are recirculated into the engine air intake for combustion, rather than being exhausted to the atmosphere. Because of the recirculation, ambient air added to the flow of blowby gas should be filtered.

This method of crankcase pressure regulation has many other advantages, one of which is that the system can be used with either low-pressure or high-pressure fuel systems, or with naturally aspirated or turbocharged engines.

The invention can be embodied in an improved crankcase pressure regulation system for an internal combustion engine burning gaseous fuel, but can also be used in liquid or slurry burning engines. The system can be used in an engine with a crankcase having a breather port through which crankcase blowby gases exit. The system includes a breather tube having an inlet that receives the crankcase blowby gases exiting the breather port and an outlet that feeds the blowby gases into an air intake housing where the blowby gases are mixed with filtered intake air. The pressure in the air intake housing is less than the atmospheric pressure because of the pressure drop across the air filter, and this pressure drop draws the blowby gases into the housing. A flow restriction, such as an oil separator, is located along the breather tube and a vacuum pressure regulator, preferably a floating-disk type vacuum pressure regulator, is operatively connected to the breather tube, preferably upstream of the oil separator. This system not only recirculates the blowby gases into the engine for combustion, but also provides a cost effective manner for maintaining slight negative crankcase pressure within narrow tolerances.

BRIEF DESCRIPTION OF THE DRAWINGS

FIG. 6 is a side elevational view of an oil separator and a floating-disk type vacuum regulator as used in the invention.

FIG. 7 is a cross-sectional view of a floating-disk type vacuum regulator taken along line 7—7 in FIG. 6.

DETAILED DESCRIPTION OF THE DRAWINGS

Prior Art

Figure 1:
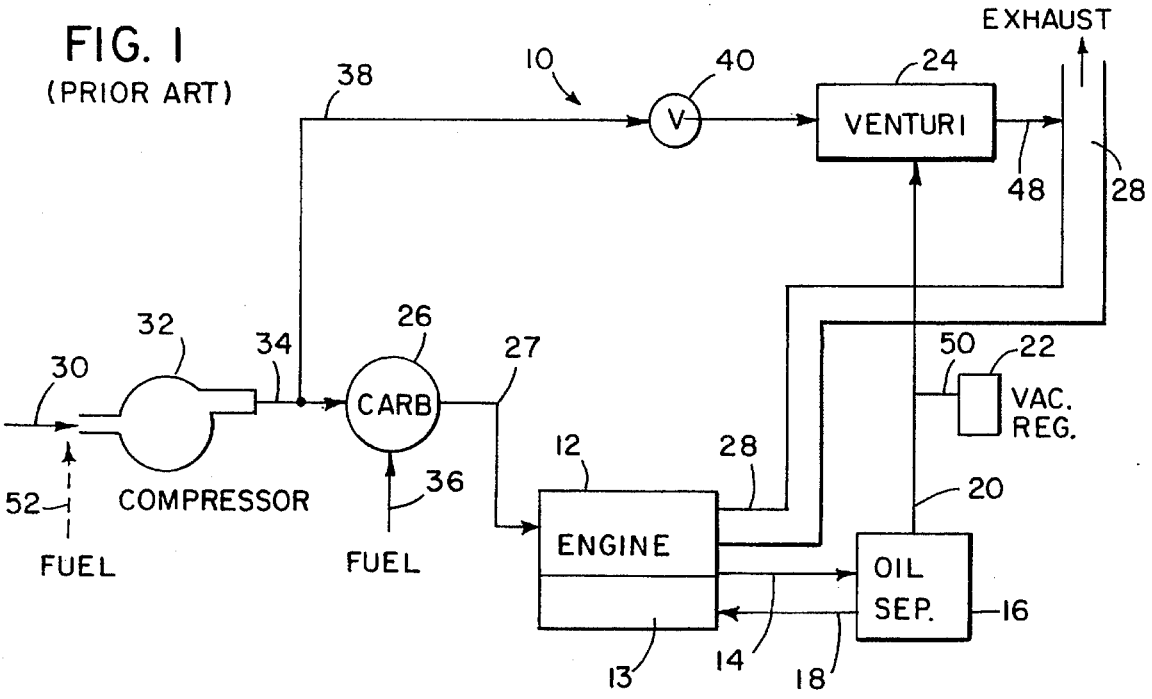
FIG. 1 (PRIOR ART)
FIG. 1 is a schematic drawing of a crankcase pressure regulation system for an internal combustion engine as is known in the prior art.

FIG. 1 shows a crankcase pressure regulation system 10 having variable air flow rates as known in the prior art. In FIG. 1, an internal combustion engine 12 has a crankcase 13. It is typical for about 0.3% of the total engine air flow to blow by the engine pistons into the crankcase 13. Blowby gases are drawn from the crankcase 13 through a breather tube 14 and flow to an oil separator 16. The oil separator separates or filters oil particulates entrained in the blowby gas in the breather tube 14. The separated oil can be returned to the engine oil reservoir through oil return line 18. From the oil separator 16, the blowby gas is drawn through line 20 into venturi 24. The pressure of the blowby gas in line 20 is regulated by vacuum regulator 22, which adds a variable amount of air into the flow through line 50 to regulate the pressure in line 20.

The engine 12 is fueled through line 27 by a high-pressure, gaseous fuel and air mixture from carburetor 26. Engine exhaust exits through exhaust tube 28. In FIG. 1, arrow 30 represents ambient air entering a compressor 32, such as a turbocharger. The compressor 32 pressurizes the engine intake air to a pressure of about 15 psig or 415 inches of water. The high-pressure air in line 34 from compressor 32 inputs carburetor 26, as does high-pressure fuel represented by arrow 36. A small percentage of the high-pressure intake air in line 34 is bled off through line 38 to drive venturi 24. An adjustable valve 40 is located in line 38 to adjust the flow of high-pressure air to the venturi 24. The high-pressure air in line 38 combines with the blowby gases in line 20 in the venturi 24, and the combined flow exits the venturi 24 through line 48 into the engine exhaust stream 28.

It is desirable to maintain the crankcase pressure at a slight negative value such as 1 to 3 inches of water (i.e. a gauge pressure of −1 to −3 inches of water). In FIG. 1, the suction or vacuum provided by venturi 24 depends on the flow through line 38 which can be controlled to a certain extent by valve 40. Valve 40 is typically a manually adjustable restriction valve. In addition, vacuum regulator 22 regulates the pressure of the blowby gas in line 20 (and thus the pressure in the breather tube 14 and the crankcase 13) by regulating the amount of ambient air drawn into line 20 through line 50. Since the flow through the venturi 24 is not typically adjusted as engine speed and load vary in the short-term, the sensitivity of the crankcase regulation system 10 depends to a large extent on the capabilities and sensitivity of the vacuum regulator 22.

The prior art crankcase pressure regulation system 10 shown in FIG. 1 requires high-pressure intake air (i.e. in line 34), and cannot be used in a low air pressure, naturally aspirated system. Also, the system 10 is not practical for internal combustion engines in which both air and fuel are compressed to a high-pressure before being fed to the engine 12, as illustrated by dotted line 52, because unburned fuel should not be flowed directly into the exhaust 28.

Present Invention

Figure 2:
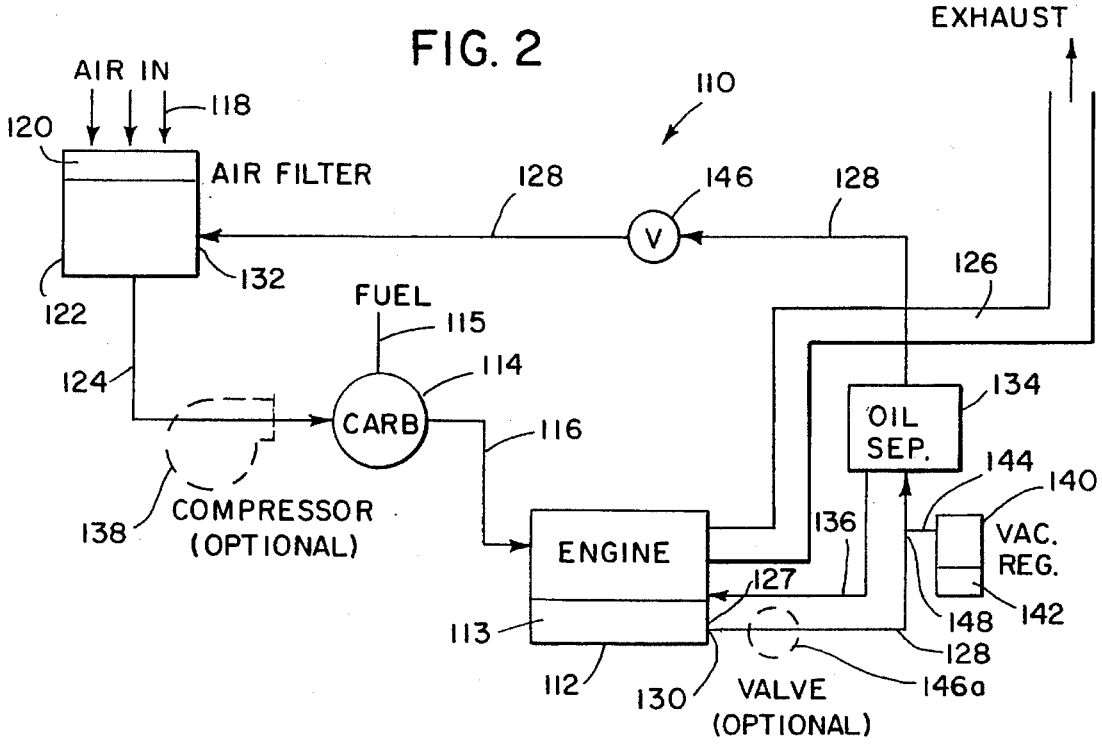
FIG. 2 is a schematic drawing of a crankcase pressure regulation system in accordance with the invention.

FIG. 2 shows a crankcase pressure regulation system 110 for an internal combustion engine 112 that is in accordance with the invention. Block 112 in FIG. 2 should be taken to illustrate that the invention can be used in any internal combustion engine having a crankcase 113 in which blowby gases are evacuated. In the particular embodiment of the invention shown in FIGS. 4–7, the engine 112 is a large, stationary internal combustion engine continuously operated to generate up to thousands of horsepower. The type of engines 112 shown in FIGS. 4–7 are used in large scale electrical and motive power generation applications such as utility company power generation, mining and pumping applications, ocean-going vessels, and so on. In the particular embodiment shown in FIGS. 4–7, the engine fuel is a gaseous fuel such as propane, natural gas, bio-gas, etc. However, the invention is not limited to gaseous fuels, and liquid or slurry fuels are possible within the scope of the invention.

Referring to FIG. 2, the engine 112 is fueled through line 116 by an air/fuel mixture from carburetor 114. Ambient air designated by arrows 118 is filtered through an air filter 120 as the air enters an air intake housing 122. Filtered air from the engine air intake housing 122 enters carburetor 114through air intake line 124 where the air is mixed with fuel designated by arrow 115. Engine exhaust exits through an exhaust manifold and an exhaust outlet designated by exhaust tube 126.

The engine 112 has a crankcase 113 that has a breather port 127 through which crankcase blowby gases can exit into a breather tube 128. Breather tube 128 has an inlet 130 that receives the crankcase blowby gases exiting the breather port 127. The breather tube 128 has an outlet 132 that feeds the blowby gases into the air intake housing 122 and into the filtered intake air flow. The crankcase blowby gases are thus recirculated into the air/fuel mix for combustion, rather than being dumped into the exhaust 126.

An oil separator 134 is located along the breather tube 128 and separates or filters out oil droplets and possibly other contaminants entrained in the flow of blowby gases through the breather tube 128. Separated oil is returned to the engine 112 through oil return line 136. The oil separator 134 provides a flow restriction for the blowby gases flowing through breather tube 128.

The air pressure at the outlet 132 of the breather tube 128 is lower than the pressure at the inlet 130 of the breather tube 128, and this pressure drop draws blowby gas from the crankcase 113 through the breather port 127. It is desirable that the pressure at the inlet 130 of the breather tube 128 be maintained at a slight negative pressure with respect to atmosphere, such as −1 to −3 inches of water. The pressure at the outlet 132 of the breather tube 128 is determined by the pressure drop across the air filter 120 between the ambient environment and the air intake housing 122. With a new air filter 120, the pressure in the air filter housing 122 typically ranges from 3–6 inches of water over typical operating speeds and loads. As the air filter 120 becomes dirty, the magnitude of negative pressure in the air intake housing 122 increases. Operators are typically instructed to replace air filters 120 when the pressure drop across the air filter reaches about 15 inches of water under typical operating speeds and loads.

The system 110 uses the pressure drop across the air filter 120 to draw blowby gas from the crankcase 113, thus eliminating the need for a venturi as was used in the prior art. Since the system 110 does not require a venturi, the system 110 does not require that the intake air be compressed, although compression is possible if desired. A compressor 138, such as a turbocharger, can optionally be placed in air intake line 124. A compressor 138 could alternatively be placed in line 116 after the carburetor 114 to provide a high-pressure, air/fuel mixture for the engine 112. The invention therefore facilitates the use of a turbocharger 138 without the need for a high-pressure fuel system.

A vacuum pressure regulator 140 is operatively connected to the breather tube 128 between the crankcase breather port 130 and the oil separator 134. The vacuum pressure regulator is preferably a floating-disk type vacuum pressure regulator, although other types of pressure regulators can be used within the scope of the invention. The vacuum pressure regulator 140 preferably has an air filter 142 that filters ambient air flowing into the vacuum pressure regulator 140. The vacuum regulator 140 adds a regulated amount of filtered air to the flow of blowby gas drawn from the crankcase 113 and flowing through the breather tube 128. The regulated amount of filtered air is added through line or elbow 144. The combined flow of blowby gases and filtered air from the vacuum regulator 140 then flows through the oil separator 134 which restricts the combined flow, and thereby causes the combined flow to lose pressure. After the oil separator 134, the combined flow flows to a manually adjustable restriction valve 146 through which the combined flow can be further restricted. It may be desirable in some applications to locate valve 146 between the breather tube inlet 130 and the location 148 where the filtered ambient air from the vacuum regulator 140 combines with the blowby gases in the breather tube 128. This alternative placement of manually adjustable valve is depicted in FIG. 2 by reference numeral **146*a*. After valve 146, the combined flow of blowby gas and filtered ambient air from the vacuum regulator 140 are fed into the air intake housing 122** and combined with filtered engine intake air.

Figure 3:
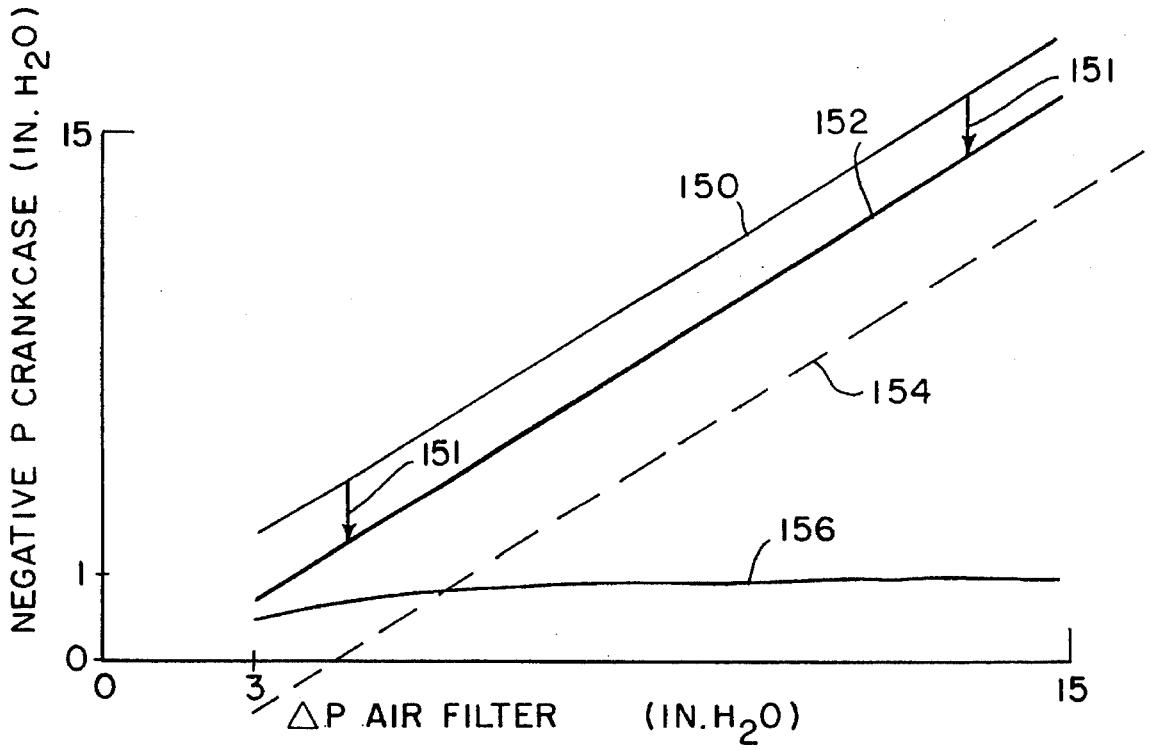
FIG. 3 is a plot illustrating crankcase vacuum as a function of pressure drop across an air filter in an internal combustion engine.

FIG. 3 is a plot illustrating negative crankcase pressure or crankcase vacuum (y-axis) as a function of pressure drop across the air filter 120 (x-axis). Curve 150 represents the relationship between air filter pressure drop and negative crankcase pressure in an unregulated breather system. Flow restrictions due to the oil separator 134 and the plumbing of the breather tube 128 cause the curve 150 to be shifted down from a curve which would represent an exact 1:1 correspondence. Adding further restrictions such as restriction valve 146 will further shift curve 150 downward as represented by arrows 151 to a location such as curve 152. As valve 146 is further closed to create more restriction, the curve will be further shifted downward, possibly even to a location such as curve 154 shown in phantom.

Curve 154 illustrates one of the reasons why a self-regulating crankcase pressure regulation system or breather system is important for internal combustion engines. Without a self-regulated breather system, an engine operator will be tempted to continually close valve 146 over time as the air filter becomes dirtier to continually shift the curve 154 downward and prevent the crankcase vacuum from becoming excessive. When the air filter 120 becomes so dirty that the pressure drop across the air filter is in the range of 15 inches of water or greater, the operator may have already closed valve 146 to a large extent to keep the crankcase vacuum within the range of 1 to 8 inches of water. Unless the valve 146 is opened when the dirty air filter 120 is replaced with a new air filter, the crankcase pressure will become positive, thereby running the risk of blowing crankcase seals.

The crankcase pressure regulation system 110 of the present invention avoids this problem as depicted in FIG. 3 by curve 156. Curve 156 represents the negative crankcase pressure or crankcase vacuum as a function of the pressure drop across the air filter 120 when a vacuum pressure regulator 140 is installed in the breather tube 128 between the crankcase breather port 127 and the oil separator 134. Curve 156 illustrates that the system 110 will produce negative crankcase pressure of about 0.5 inches of water when there is a pressure drop across air filter 120 of about 3 inches of water. The curve 156 further illustrates that the negative crankcase pressure increases slightly as the pressure drop across the air filter 120 increases. When the pressure drop across the air filter 120 is about 15 inches of water, the negative crankcase pressure is about 0.9 inches of water. It can therefore be appreciated that the crankcase pressure regulation system 110 requires a change of about 30 inches of water in the pressure drop across the air filter 120 to change the negative crankcase pressure by 1 inch of water. Therefore, when using the system 110, an operator need not adjust valve 146 to account for pressure drop across a dirty air filter 120.

Referring again to FIG. 2, while it is possible to operatively connect vacuum pressure regulator 140 to breather tube 128 downstream of oil separator 134, it has been found that locating vacuum pressure regulator 140 upstream of oil separator 134 improves the sensitivity of the system 110 and allows the vacuum pressure regulator 140 to be smaller in size or more compact. The primary advantage of placing the vacuum pressure regulator 140 before the oil separator 134 is that this placement provides an increased volumetric flow through the oil separator 134. The oil separator 134 is a restriction to the flow and the magnitude of the pressure drop across the oil separator 134 is proportional to the square of the volumetric flow through the oil separator 134. Therefore, as more ambient air is pulled through the vacuum pressure regulator 140 through line 144 into breather tube 128, the oil separator 134 works harder to restrict the flow (i.e. proportional to the square of the volumetric flow), thereby lessening the suction or vacuum applied to the crankcase 113 through the breather port 127. In fact, system 110 has two flow restrictions downstream of the vacuum pressure regulator 140: the oil separator 134 and the manually adjustable valve 146. By using the vacuum pressure regulator 140 upstream of these restrictions, less air needs to be drawn in through the vacuum pressure regulator 140 to maintain a constant crankcase vacuum because with this placement, an increase in flow rate of ambient air into the system 110 rapidly increases the overall system restriction.

Another advantage of locating the vacuum pressure regulator 140 upstream of the oil separator 134 is that the oil separator 134 can act as a second air filter, in addition to air filter 142, for the ambient air drawn into the system 110 by the vacuum pressure regulator 140. Another possible advantage of locating the vacuum pressure regulator 140 upstream of the oil separator 134 is that the ambient air drawn into the system 110 is likely to be significantly cooler than the blowby gases in the breather tube 128, and this may help condense oil vapors in the blowby gas thereby increasing the efficiency of the oil separator 134.

Figure 4:
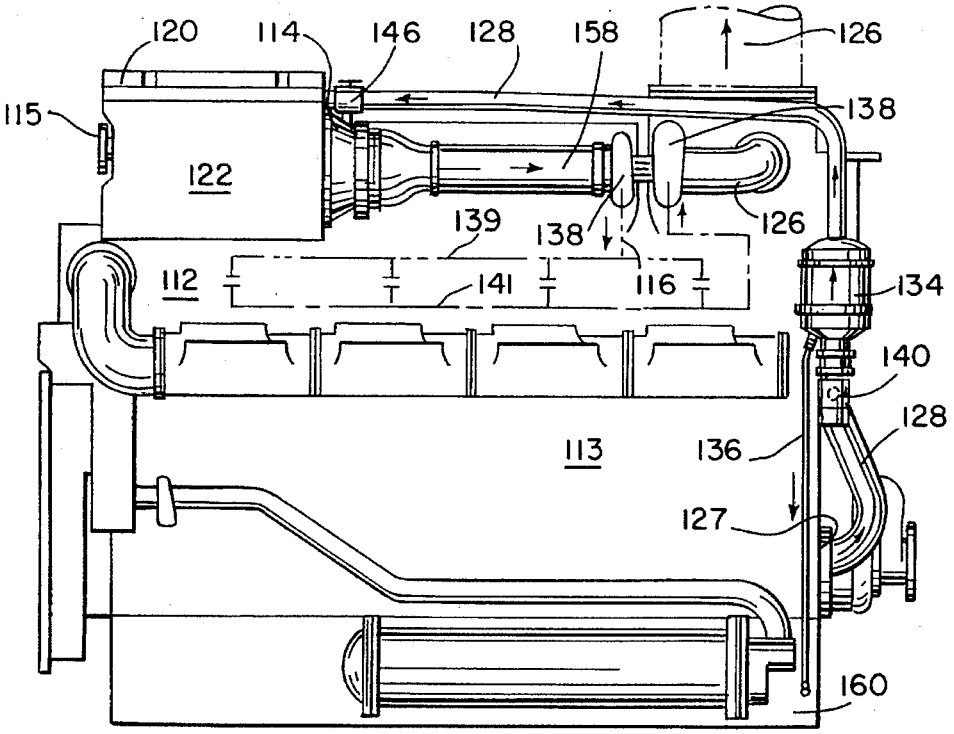
FIG. 4 is a schematic side elevational view of a stationary internal combustion engine having a crankcase pressure regulation system in accordance with the invention as shown in FIG. 2.
Figure 5:
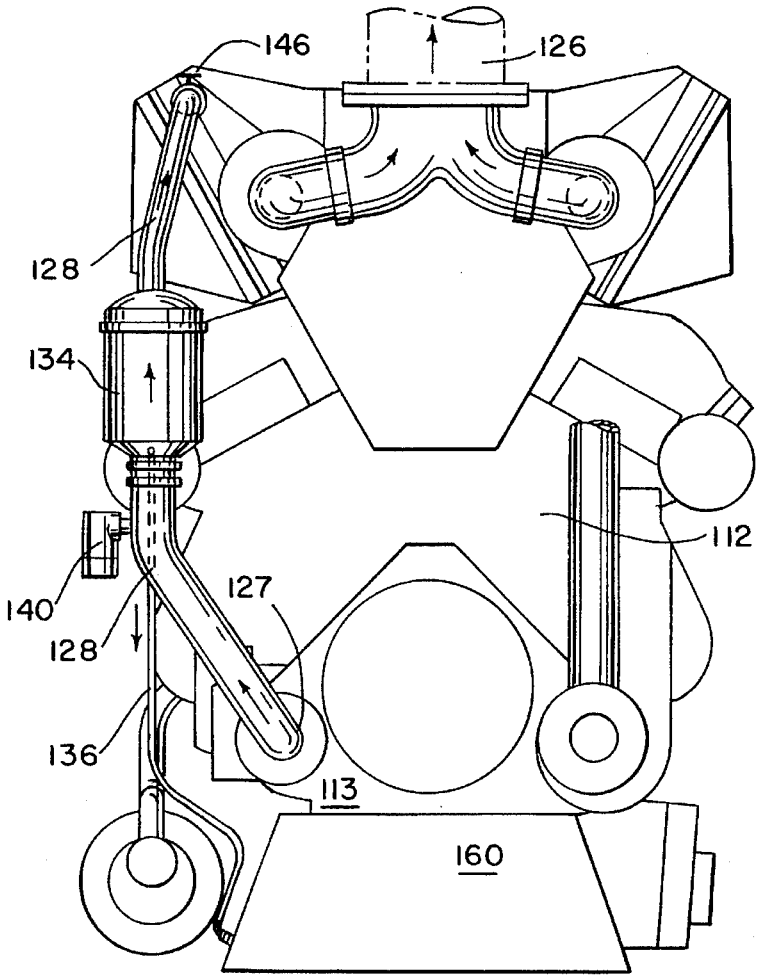
FIG. 5 is a schematic front elevational view of the stationary internal combustion engine shown in FIG. 4.

FIGS. 4 and 5 show the invention as implemented in a large, stationary internal combustion engine having a V8 configuration and, by way of example, a 48 liter displacement. In FIGS. 4 and 5, blowby gases exit the crankcase 113 through breather port 127, which is located towards the bottom of the engine 112, into breather tube 128. The breather tube 128 extends vertically along the side of the engine 112 and then horizontally along the top of the engine 112 to an air intake housing 122. An oil separator 134 is located in the horizontal portion of the breather tube 128, and a vacuum pressure regulator 140 is connected to the breather tube 128 between the breather port 127 and the oil separator 134. Oil separated from the blowby gas in the separator 134 is returned to oil reservoir 160 through oil return line 136. A manually adjustable control valve 146 is located in the horizontal portion of the breather tube 128 near the air intake housing 122. Ambient air is drawn through an air filter 120 into the air intake housing 122 and is combined therein with the recirculated blowby gases. Fuel such as natural gas or bio-gas inputs the engine through fuel inlet 115. The air and fuel are mixed in carburetor 114 and the mixture flows through tube 158 to turbocharger 138 where the mixture is pressurized or compressed. From the turbocharger 138, the fuel and air mixture inputs the engine intake manifold shown schematically as 139 in FIG. 4. Engine exhaust exits through exhaust manifold shown schematically as 141, and is used to power turbocharger 138 before being exhausted through exhaust tube 126.

FIG. 6 illustrates the oil separator 134 and the preferred vacuum pressure regulator 140. The oil separator 134 is a conventional oil separator, except that the oil separator 134 includes an oil dam 162. The oil separator 134 has an inlet tube 164 which is connected to breather tube 128 with coupling 166. The oil separator 134 has an outlet tube 168 which is connected to the breather tube 128 with coupling 170. In operation, it is not desirable for oil or other matter which has been separated to flow back down through inlet 164 into breather tube 128. In order to minimize the occurrence of such backflow, the inlet tube 164 for the oil separator 134 extends upward above the bottom surface 172 of the oil separator to provide an oil dam 162. The oil dam 162 promotes pooling of separated oil and other contaminants. The oil return line 136 is connected to a drain hole 174 located through the bottom surface 172 of the oil separator 134 in a location where pooling is likely to occur, thus promoting the effectiveness of the oil return line 136 and discouraging backflow down through the breather tube 128.

FIG. 7 shows the preferred floating-disk type vacuum pressure regulator 140. The vacuum pressure regulator 140 has a housing 176 which has an ambient air inlet hole 178 and an outlet hole 180. Elbow 144 connects the housing 176 to the breather tube 128 so that air can flow from the internal chamber 182 within the housing 176 into the breather tube 128. A vertical rod 184 is screwed into the housing 176 and extends downward through the ambient air inlet hole 178. A floating disk 186 is slidably mounted to the rod 184 by attaching the floating disk 186 to a slidable sleeve 188 with a snap ring 190. When the floating disk 186 is located in the lowermost position, the outer edge of the floating disk 186 settles on an O-ring 192 located in a groove in the housing 176 around the periphery of the ambient air inlet hole 178. A foam air filter 194 filters ambient air flowing into the vacuum pressure regulator 140 through the ambient air inlet 178. The foam air filter 194 is held in place with a generally cylindrical metal screen 196 that is attached to the lower end of the rod 184 by nut 198.

The sleeve 188 and the floating disk 186 slide freely along rod 184 against the weight of gravity. When the pressure in breather tube 128 at location 148 is sufficiently low, the pressure gradient will cause the floating disk to raise upward against the force of gravity, thus allowing ambient air to flow through filter 194 into chamber 182 and subsequently into the breather tube 128. As the pressure difference between location 148 and the atmosphere increases, the floating disk 186 will raise higher, thus allowing more ambient air to flow through filter 194 into the breather tube 128.

It should be recognized that various alternatives, equivalents and modifications are possible, and that these alternatives, equivalents and modifications should be considered to be within the scope of the appended claims.

I claim:

1. In an internal combustion engine having a crankcase, an improved crankcase pressure regulation system comprising:

an engine air intake;

an air filter that filters ambient air to provide filtered intake air to the engine air intake;

a crankcase having a breather port through which crankcase blowby gases exit;

a breather tube having an inlet that receives the crankcase blowby gases exiting the breather port and having an outlet that feeds blowby gases into the filtered intake air flow;

an oil separator located along the breather tube; and a vacuum pressure regulator that adds a regulated amount of ambient air to crankcase blowby gases flowing through the breather tube at a location between the crankcase breather port and the oil separator.

2. A crankcase pressure regulation system as recited in claim 1 wherein the vacuum pressure regulator has an air filter that filters ambient air flowing into the vacuum pressure regulator.

3. A crankcase pressure regulation system as recited in claim 2 wherein the vacuum pressure regulator is a floating-disk type vacuum pressure regulator.

4. A crankcase pressure regulation system as recited in claim 1 further comprising a manually adjustable restriction valve located along the breather tube between the oil separator and the breather tube outlet.

5. A crankcase pressure regulation system as recited in claim 1 further comprising a manually adjustable restriction valve located along the breather tube between the breather tube inlet and the location along the breather tube at which the vacuum pressure regulator is operatively connected to the breather tube.

6. A crankcase pressure regulation system as recited in claim 1 further comprising a compressor that compresses the filtered intake air flowing to the engine air intake downstream of the location where the blowby gases from the breather tube outlet are fed into the filtered intake air flow.

7. A crankcase pressure regulation system for an internal combustion engine as recited in claim 1 wherein the internal combustion engine uses a gaseous fuel.

8. A crankcase pressure regulation system for an internal combustion engine as recited in claim 7 wherein the gaseous fuel is supplied to the internal combustion engine at a pressure less than the engine intake manifold pressure.

9. In an internal combustion engine having a crankcase, a method of regulating pressure in the crankcase comprising the steps of:

creating a negative pressure in the crankcase by drawing a flow of blowby gas from the crankcase; and regulating the negative crankcase pressure by adding a regulated amount of air to the flow of the blowby gas drawn from the crankcase and restricting the flow of the blowby gas drawn from the crankcase after the ambient air has been added to the blowby gas.

10. A method of regulating pressure in a crankcase as recited in claim 9 comprising the additional step of:

further restricting the combined flow of the blowby gas and ambient air with an adjustable valve.

11. A method of regulating pressure in a crankcase in an internal combustion engine as recited in claim 9 comprising the additional step of:

restricting the flow of the blowby gas drawn from the crankcase before adding the ambient air to the flow of the blowby gas.

12. A method of regulating pressure in a crankcase in an internal combustion engine as recited in claim 9 further comprising the step of:

feeding the combined flow of blowby gas and ambient air to an engine air intake to combine the blowby gas with engine intake air and recirculate the blowby gas into the internal combustion engine.

13. A method of regulating pressure in a crankcase in an internal combustion engine as recited in claim 12 wherein the ambient air added to the flow of blowby gas is filtered before being added to the blowby gas.

14. A method of regulating pressure in a crankcase in an internal combustion engine as recited in claim 12 further comprising the step of:

compressing the engine intake air combined with the recirculated blowby gas before the combined flow enters the engine cylinders.

15. A method of regulating pressure in a crankcase in an internal combustion engine as recited in claim 9 wherein the blowby gas is drawn from the crankcase by a regulated vacuum that is driven by a pressure drop across an engine air filter that is provided by filtering the engine intake air through the air filter.

16. In an internal combustion engine having a crankcase, an improved crankcase pressure regulation system comprising:

an engine air intake;

an air filter that filters ambient air to provide filtered intake air to the engine air intake;

a crankcase having a breather port through which crankcase blowby gases exit;

a breather tube having an inlet that receives the crankcase blowby gases exiting the breather port and having an outlet that feeds blowby gases into the filtered intake air flow;

an oil separator located along the breather tube; and a floating-disk type vacuum pressure regulator operatively connected to the breather tube, the floating-disk type vacuum pressure regulator having an air filter that filters ambient air flowing into the vacuum pressure regulator.

* * * * *